United States Patent [19]

Bolanz

[11] 4,073,104

[45] Feb. 14, 1978

[54] BUILDING CONSTRUCTION SYSTEM

[76] Inventor: Gerrit M. Bolanz, Basler Str. 59, D-7858 Weil-Otterbach, Germany

[21] Appl. No.: 566,059

[22] Filed: Apr. 8, 1975

[30] Foreign Application Priority Data

Apr. 19, 1974 Germany .....2418824

[51] Int. Cl.[2] ..... E04G 21/00; E04B 1/00; E04B 1/74

[52] U.S. Cl. ..... 52/125; 52/234; 52/235; 52/127; 52/404; 52/745

[58] Field of Search ..... 52/79, 125, 122, 127, 52/234, 235, 236, 404, 474, 476, 477, 487, 488, 66, 745, 204, 202, 220

[56] References Cited

U.S. PATENT DOCUMENTS

| | | | |
|---|---|---|---|
| 2,499,498 | 3/1950 | Hammond | 52/125 X |
| 2,641,449 | 6/1953 | Antony | 52/236 X |
| 2,922,299 | 1/1960 | Deam | 52/125 X |
| 3,315,426 | 4/1967 | Rolland | 52/235 |
| 3,331,181 | 7/1967 | Schmidt | 52/125 X |
| 3,466,818 | 9/1969 | Van Der Lely | 52/404 |
| 3,576,092 | 4/1971 | Halpern | 52/204 |
| 3,715,848 | 2/1973 | Jordan | 52/235 |
| 3,830,025 | 8/1974 | Wainshal | 52/125 X |
| 3,885,367 | 5/1975 | Thunberg | 52/204 |

FOREIGN PATENT DOCUMENTS

| | | | |
|---|---|---|---|
| 1,259,041 | 3/1961 | France | 52/745 |
| 700,864 | 1/1966 | Italy | 52/745 |

*Primary Examiner*—J. Karl Bell

*Attorney, Agent, or Firm*—Watson, Cole, Grindle & Watson

[57] ABSTRACT

A system devised for constructing a building from a plurality of parts which can be mass-produced at a factory and readily assembled at a construction site. This building construction system includes a plurality of vertical supports and a plurality of corresponding horizontal supports which can be rigidly connected to the vertical supports. A plurality of frame members are provided, each of which can be freely suspended in a position defined by at least one vertical support and at least one horizontal support. The frame members are held in position between such supports without being fixedly attached to the supports.

17 Claims, 7 Drawing Figures

BUILDING CONSTRUCTION SYSTEM

BACKGROUND OF THE INVENTION

The present invention relates to a building construction system which can be formed from prefabricated members and readily constructed at a construction site.

Various methods of constructing buildings from stone and concrete, in prefabricated concrete unfinished parts, are presently known. In such constructions, the prefabricated concrete parts are set one upon another and are built up on a construction site. The construction site of such structures, however, requires a great deal of highly expensive professional tradework.

One solution which has been attempted to decrease the amount of job-site work required in the construction of concrete buildings has been the utilization of concrete compartment cells. Such cells are placed one upon another for constructing the building. The transport of such cells, however, becomes a significant problem. Additionally, such concrete skeleton structures, including those having steel parts with joint plates on the ends to be welded together, generally lack sufficient static strength and hence can only be utilized for constructing either one or two story buildings.

All of these structures suffer from the shortcoming of requiring a relatively long building time due to the large amount of constructural work which must be done at the building site. The high costs which arise from the required amount of labor for such construction becomes a significant economic factor. Additional problems which also arise are the unhealthy residential quality exhibited by the resulting structure due to the materials utilized, the problems of transporting the structures to the job site, the susceptability of the resulting structures to vibrations and the cost of upkeep of the structures subsequent to construction.

SUMMARY OF THE INVENTION

An object of the present invention is to provide a building construction system which can be readily and economically assembled at a job site from prefabricated building elements.

Another object of the present invention is to provide a building construction system which enables buildings of different types to be readily assembled out of relatively few, similar, fully-industrially made, standardized parts.

In devising the various parts for the construction system, it is desirable that it be possible to construct buildings which are either one or multi-storied and can be designed in various forms. It is additionally desirable for the resulting building to be relatively vibration proof and convenient for living without the occurrence of expensive upkeep costs. Additionally, it is desirable if the buildings do not require a permanent structural frame and concrete form so that it is possible to remodel or add to the building as well as to take down the building and reassemble it elsewhere.

These purposes are achieved in accordance with the present invention by providing a building construction system which includes vertical and horizontal supports which can be fixedly secured together and frame members which can be freely suspended between the supports and cantileverly to-ward the surface. In positioning the frame members on the horizontal and vertical supports, it is intended that the frame members fit into corresponding receiving portions on the supports so as to be held in place by the support without a need for fixedly securing, such as for example, by welding or bolting the frame to the supports, i.e., the frame is freely suspended in position on the vertical and horizontal supports.

In this building construction system of the present invention, the vertical and horizontal supports both have H-shaped cross-sectional profiles. Additionally, these supports are provided with recessed portions so as to enable the supports to be meshed together at the recessed locations. The supports are then bolted together at these locations so as to fixedly secure them. The horizontal supports additionally serve as a floor support for the floors of the building. Each of the horizontal supports is also provided with a plurality of notches along its longitudinal axis. Each of the frame members has an outwardly extending flange, extending in a vertical direction, on its upper and lower edges. The flanges of the frame members are inserted in the notches of the horizontal supports and thus position the frame members in place. In this manner, the frame members are freely suspended between the horizontal and vertical supports.

The frame members which are attached to the outside of the building need only be connected on one side by a vertical support and can be left free at the other side. In this manner, it is possible to save on the number of supports needed for the outside of the building, thereby resulting in a cost reduction.

Various different construction members can then be attached to the frame members along the outside of the building. Such construction members include wall units, window units and balcony units. Each of these construction members has a slideable member along its (upper and) lower edges. The slideable members on the construction members can be slid into the spaces which exist between vertically adjacent frame members thereby connecting the frame members by the construction members.

Since the construction members are each of essentially the same size, the members can be easily interchanged with one another. For the same reason, even years after construction of the building is completed, it is possible for one type of construction member (e.g., a wall unit) to be interchanged with another (e.g., a window unit) thus redesigning the building. Additionally, the construction members can be removed and the frame members exposed. With the frame members then exposed, an expansion can be built onto the building without necessitating any reconstruction of the existing structure.

If desired, it is possible in order to provide for additional strength of the structure for the portions of the frame which are inserted within the slots in the horizontal supports to be bolted into place. Even if such portions are bolted into place, the remaining portions of the frame members still remain freely suspended in position between the vertical and horizontal supports. Additionally, it is possible to utilize a plurality of reinforcing struts, rectangular plates or sharp angled plates, arranged between vertically adjacent members for increasing the stability of the structure. The utilization of such reinforcing members dispenses with the necessity of utilizing outside props for improving the stability of the structure.

The roof for this building system can be formed as a single piece which is merely laid on top of the upper horizontal supports. The roof can be later removed and additional supports placed on top so as to add additional floors to the building and then the roof can be again put back in place. In this manner, it is not only possible to add to the width of the building but it is also possible to increase the height of the building without any requirements for an elaborate scaffolding setup and reconstruction of the entire structure.

All of the various supports, frame members and construction members can be made on a mass production and industrial basis from either iron or aluminum. The production process can be standardized so as to enable such mass production. Additionally, since the various elements can be bolted together for assembly, the necessity of time consuming welding work is eliminated.

In accordance with one specific aspect of the invention, it is possible to form a construction member which includes both a wall unit and a window unit, with both units being specifically designed for increasing the efficiency of the heating system within the building. The wall unit of this construction member includes an inner wall having a trapezoidal cross section so as to form hollow spaces facing in the interior and exterior directions. The hollow spaces facing in the exterior direction are filled with an insulating material. An insulating plate is securely fixed over the outer face of the inner wall. A heatconducting plate is arranged adjacent to the inner face of the inner wall member. The window unit includes an outer sheet of insulating glass and an inner single sheet of glass.

DESCRIPTION OF THE PREFERRED EMBODIMENTS

Figure 1:
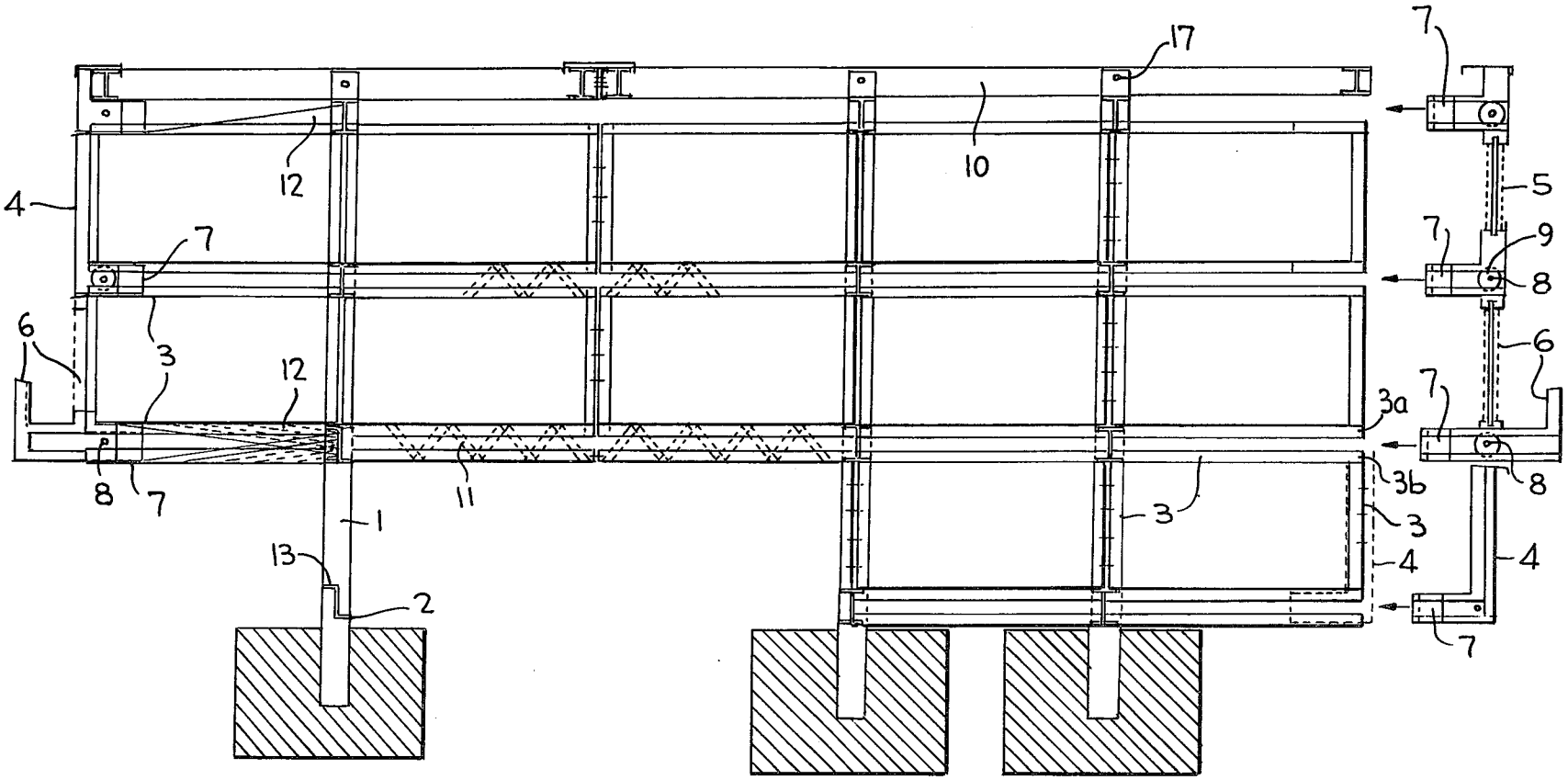
FIG. 1 is a sectional view of a building constructed in accordance with the building construction system of the present invention.

A building constructed from the basic construction parts of the present invention is illustrated in FIG. 1. As shown, a plurality of vertical supports 1 are interconnected with a corresponding plurality of horizontal supports 2 so as to intersect along mutually orthagonal directions. The vertical supports can be anchored to the ground as shown at the bottom of the illustrated building.

Figure 3:
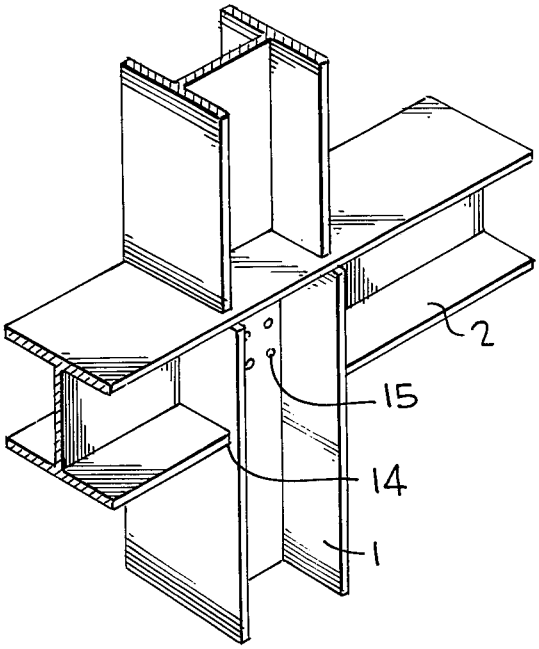
FIG. 3 provides an illustration of interconnected vertical and horizontal supports according to the present invention.
Figure 5:
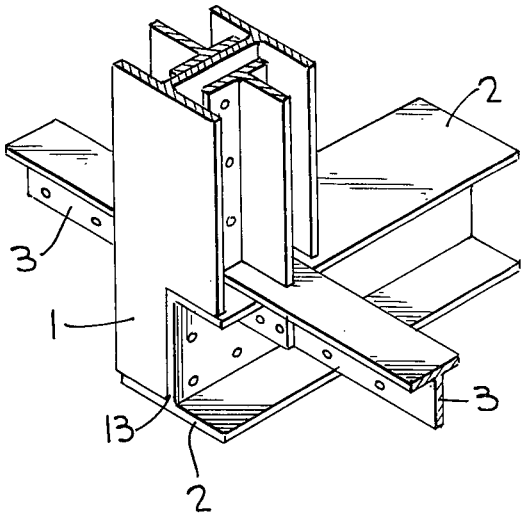
FIG. 5 provides a perspective view of the interconnected three basic elements in which the horizontal support is set on a foundation.
Figure 4:
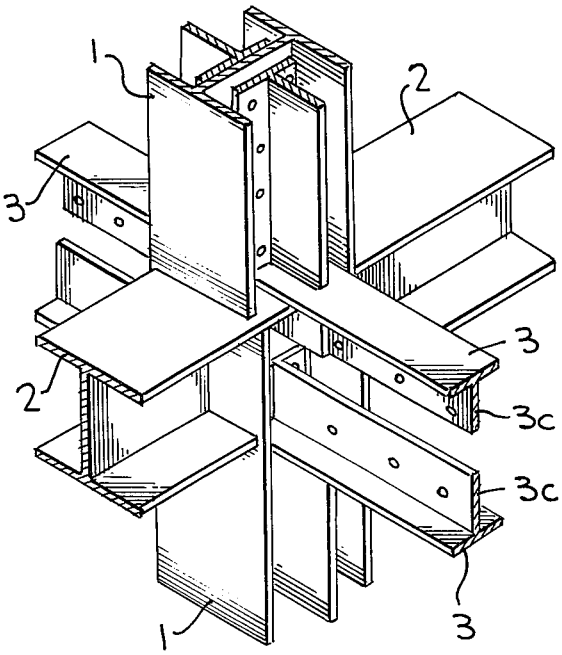
FIG. 4 is a perspective view of the interconnected vertical and horizontal supports shown in FIG. 3 with corresponding frame members being inserted in place.
Figure 6:
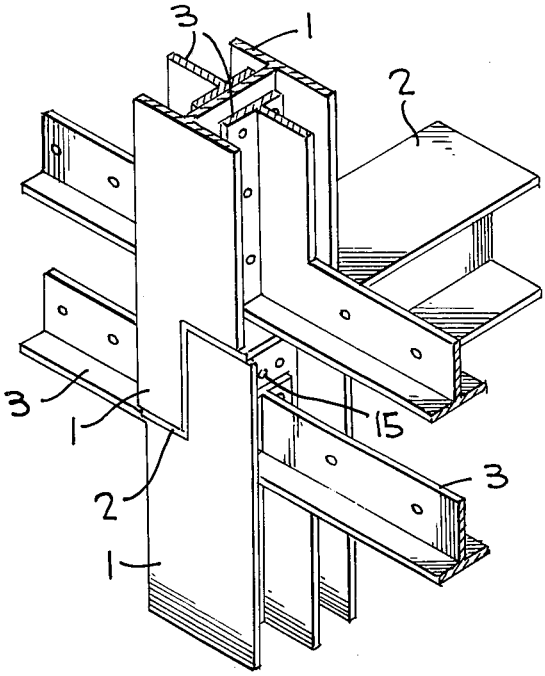
FIG. 6 is a view similar to that shown in FIG. 4 except that the vertical supports are positioned at the end of the horizontal supports since the supports are to be arranged at the outside corners of the building.
Figure 7:
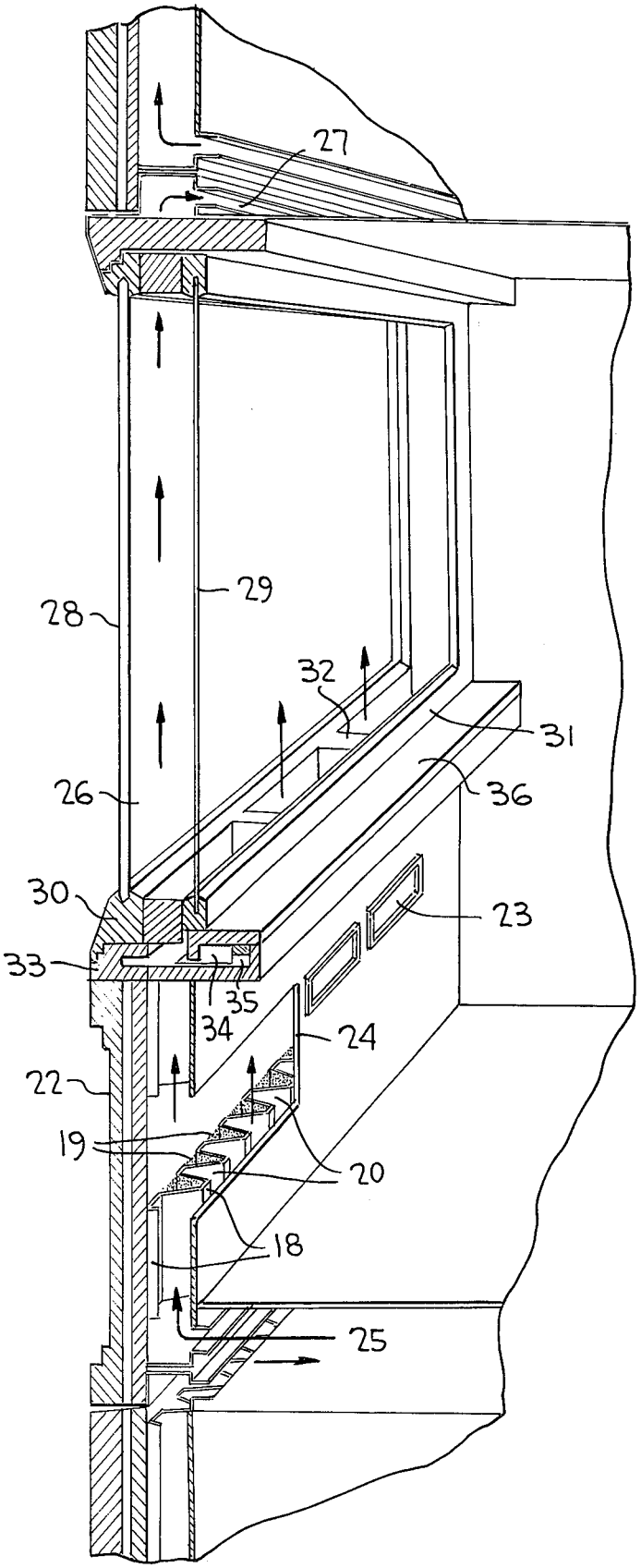
FIG. 7 shows a construction member in accordance with the present invention including a wall unit and a window unit.

Each of the vertical and horizontal supports have an H-shaped cross-sectional profile as shown in FIG. 3. Frame members 3 are positioned with their lateral ends arranged within corresponding H-shaped portions of the vertical sections. Horizontal supports 2 are provided with a plurality of slots 16 which are equally spaced along the longitudinal axis of each support. Frame 3 has on its upper and lower ends, flanges 3*c*. When the frame members are inserted within the vertical supports, flanges 3*c* fit within slots 16 of horizontal supports 2. In this manner, frame members 3 are freely suspended in place between the vertical and horizontal supports.

Various different construction members are then attached to the building. These construction members can be either an outer wall unit 4, a window wall unit 5 or a balcony unit 6. Each of the construction members, however, includes (top and) bottom slide carriages 7, each of which has a roller bearing 8 and a corresponding roller 9. Slide 7 of the construction member is then slide into the space between an adjacent lower edge 3*a* of an upper frame member and an upper edge 3*b* of the adjacent lower frame member. In this manner, the construction member is held in place by the frame members. By screwing together a rigid shell is achieved.

It is possible to utilize a plurality of struts 11 or plates 12 extending between vertically adjacent frame members. These struts and plates help to increase the stability of the construction. Plates 12 can be of either a rectangular or triangular shape.

After the building is constructed, a roof 10, which can be made from a single piece of material, is placed on top of the upper supports. In order to enable this roof to be easily removed whenever desired, it is provided with a hook opening 17. Hence, if the building is to be later added to, it is merely necessary to remove the roof and continue the construction in the upward direction.

Figure 2:
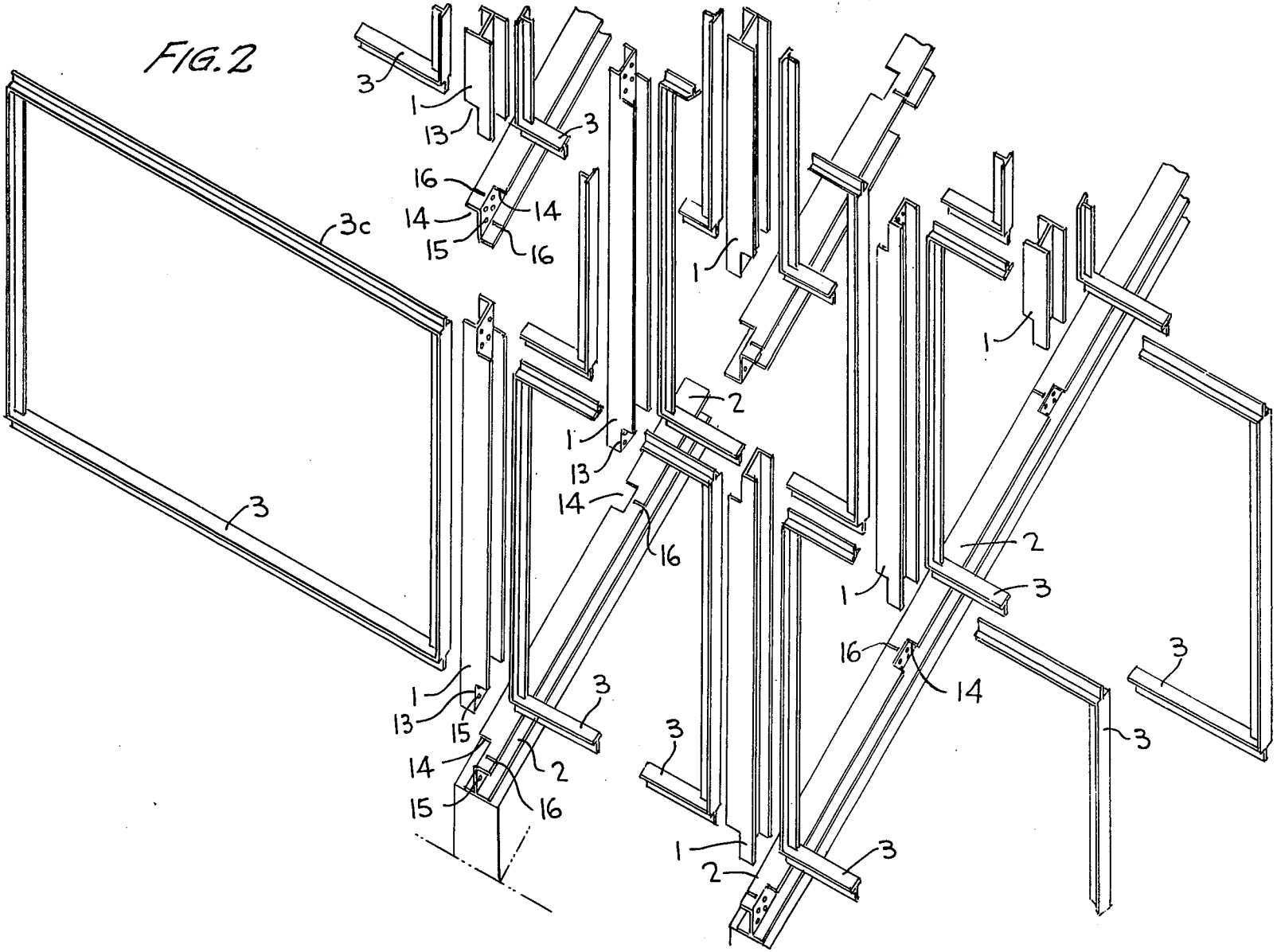
FIG. 2 is an exploded perspective view of a portion of the system illustrated in FIG. 1 so as to provide an illustration of the three basic elements of the building system.

After vertical and horizontal supports have been arranged in their mutually intersecting positions, bolts can be inserted through bolts holes 15 for securing the supports together. The frames, however, are merely held in place in a freely suspended arrangement between the vertical and horizontal supports since their lateral edges are positioned within the grooves of the H-shaped cross section of the vertical supports and their flanges are arranged within the slots of the horizontal supports. Hence it is not necessary for the frames to be bolted into place. The relationship between these various members can be clearly seen from the illustration in FIG. 2. The relationship between intersecting the vertical and horizontal supports and the frame members can be seen from the arrangement shown in FIGS. 3 through 6. As can be seen from these figures, vertical support 1 has a unilateral recess 13, i.e., both legs of the H are cut out on one side. The horizontal support, however, only has a quarter recess 14, i.e., only one leg of the H is cut out. Frame member 3 can be seen with its lateral edge positioned within the H-shaped portion of vertical support 1. Flange 3*c* fits into slot 16 in the horizontal support. In this manner, the frame member is held in place between the vertical and horizontal supports.

Each construction member has the same dimensions so that the members can be interchangeable with one another for redesigning the building. Additionally, the width of the members corresponds to the distance between slots 16 in horizontal supports 2. Furthermore said distances corresponds to the height of each construction member which height is equivalent to the height of the story of a building.

After a shell of the building is constructed from vertical supports 1, horizontal supports 2, frame members 3 and corresponding construction members 4, 5 and 6, the various wall members can then be inserted. These wall members which include both slideable walls and wall boards can be coupled to the inner sides of the construction members and then extended in directions both parallel and perpendicular to such members. Each slideable wall and wall board member has a pivotable bearing connected at its base edge. This pivotable bearing is adapted to slide along a plurality of guide tracks arranged in mutually orthagonal and intersecting lines so as to enable the various walls to be positioned in place.

In accordance with constructing a building of the type described above, it is possible to utilize construction members which are specifically designed to increase the heating efficiency of the resulting building. In constructing buildings of conventional design with the sides of stone and concrete and windows set therein, a higher consumption of energy is necessary in order to keep the rooms within the building at the desired temperature level. One reason for this problem results from the utilization of the masonary construction which increases the dampness and thus the cold temperature of the structure. The dampness and coolness of the masonary penetrates through the walls and windows thus decreasing the heating efficiency within the building. Moreover, such masonary structures allow the rooms within the building to be highly subjected to the exterior weather conditions. These conditions must then be compensated for by the temperature control within the building thus making the building inefficient with respect to energy consumption and hence increasing the costs of operation of the building.

In order to overcome such problems, the construction member can be provided with a wall unit having a specific construction for substantially eliminating such problems. This can be achieved with the utilization of a sandwich type wall structure which insulates the rooms in the building from exterior weather conditions. These wall units include a vertically extending inner wall 18 having a trapezoidal cross-sectional profile. This wall presents exterior facing hollow spaces 19 and interior facing hollow spaces 20. Exterior spaces 19 can be filled with a suitable insulating material, such as, for example, a foam material, so that the wall exhibits an increased temperature insulation over 90 to 95 percent of the total surface. Interior spaces 20, however, remain hollow and enable the flow of warm or cold air through the wall unit.

An insulating plate 21 is secured to the exterior side of wall 18. Next, an outer plate 22 constituting an outer wall, is fixed to the insulating plate. This outer wall can be formed of a single molded piece. A heat conducting plate 24 is arranged adjacent to the interior side of inner wall 18. Sliding lattice plates 23 are positioned within heat conducting plate 24 for enabling the heated or cooled air passing through hollow spaces 20 to be directed into the room. Since the heat conducting plate is 90 to 95 percent heat emitting, it makes the utilization of radiators unnecessary and hence decreases the amount of energy necessary to heat the room.

Arranged within the wall unit is a specially constructed window unit which is constructed so as to also take into account energy efficiency. The window unit is constructed with two pieces of glass, an outside insulating glass 28 and a single sheet of inner glass 29. An interior window chamber 26 is thus provided between the two sheets of glass. Insulating glass 28 is held within the frame 30 and glass 29 is held within a frame 31. Separating these frames are cross members 32. Cross members 32 are provided with a plurality of openings which enable the passage of air through interior window chamber 26. Thus air can enter through an inlet opening 25 at the bottom of the wall unit, pass up through hollow spaces 20 of inner wall 18, pass through interior window chamber 26 and finally leave the wall unit through an outlet opening 27. At the bottom of the window unit at its intersection with the wall unit, a window sill formed from an intermediate piece 33 is provided helping to hold the window in place. Connected to the sill is a removable ledge 36 within which is arranged a slide 34 and spring 35, closing the air canal and interrupting the air supply when the window is opened or the sliding lattice plate 23 1st opened.

It is noted that the above description and the accompanying drawings are provided merely to present exemplary embodiments of the present invention and that additional modifications of such embodiments are possible within the scope of this invention without deviating from the spirit thereof.

What is claimed is:

1. A building construction system comprising:

a plurality of vertical supports, each having opposing U-shaped grooves extending along its longitudinal axis;

a plurality of horizontal supports adapted to be fixedly connected to said vertical support, each horizontal support having opposing U-shaped grooves extending along its longitudinal axis;

a plurality of rectangular frame members having outwardly exending flanges along at least two of its peripheral surfaces, each frame member being adapted to be freely suspended in a position defined by at least one vertical support and at least one horizontal support by arranging said flanges within corresponding U-shaped grooves, adjacent frame members being spaced from each other by a short distance; and further comprising construction members connectable to said frame members and having slideable members adapted to be slideably inserted in the spaces between adjacent frame members for connecting said construction members to said frame members.

2. A system as defined in claim 1 wherein said construction members comprise outer wall units.

3. A system as defined in claim 2 wherein each said slideable member includes a roller bearing and a corresponding roller and said slideable member is positioned along an outer edge of the respective said construction member.

4. A system as defined in claim 2 wherein each of said construction members has substantially the same dimensions so that said construction members are interchangeable.

5. A system as defined in claim 1 further comprising a roof member formed as a single unit and adapted to be set upon a top of a building constructed from said vertical supports and said horizontal supports, said roof member being provided with a lifting hook for enabling its movement with respect to the building.

6. A system as defined in claim 1 wherein said vertical supports and said horizontal supports are adapted to be bolted together.

7. A system as defined in claim 1 wherein both said vertical supports and said horizontal support have H-shaped cross-sections.

8. A system as defined in claim 1 wherein: each of said horizontal supports includes a plurality of notches equally spaced along its longitudinal axis; said vertical supports are adapted to be secured to said horizontal supports at such notches; and, the height and width of said construction members are such so as to correspond to the distance between said notches and to correspond to the height of a single story of a building.

9. A system as defined in claim 1 wherein at least one of said construction members comprises an outside wall unit and a window unit.

10. A system as defined in claim 1 further comprising a plurality of struts and triangular plates arranged between adjacent said frame members extending in a vertical direction.

11. A system as defined in claim 7 wherein each said frame member has an outwardly extending flange on its upper and lower edges; both said vertical supports and said horizontal supports are provided with recesses; each said recess has a plurality of holes for receiving corresponding bolts for bolting said supports together; said recesses on said vertical supports are unilateral recesses; said recesses on said horizontal supports are quarter recesses; and said horizontal supports also have a plurality of slots equally spaced along its longitudinal direction for receiving said flanges of said frame members.

12. A system as defined in claim 1 wherein each of said construction members comprise a wall unit having an inner wall member having a trapezoidal cross-sectional profile presenting hollow interior facing and exterior facing spaces; said interior hollow spaces serving as air ducts; insulating material arranged within said exterior hollow spaces of said inner wall member; an insulating plate securely fixed to the exterior side of said inner wall member; and a heat conducting plate arranged adjacent to the interior side of said inner wall member.

13. A system as defined in claim 12 wherein each said wall unit has an opening therein; and further includes a window unit arranged within said opening in said wall unit, said window unit including a sheet of insulating glass arranged on the exterior side of said wall unit and a single sheet of glass arranged on the interior side of said wall unit, and cross pieces spaced between the peripheral edges of both said sheets of glass.

14. A system as defined in claim 13 further comprising an intermediate shaped in the form of a window sill interposed between said window unit and said wall unit containing a slide and a spring for interrupting air supply when window is opened.

15. A system as defined in claim 12 wherein said exterior insulating plate is formed as a single unit by a molding process.

16. A system as defined in claim 1 wherein said construction members comprise window units.

17. A system as defined in claim 1 wherein said construction members comprise balcony units.

* * * * *